US006185843B1

(12) United States Patent
Stone et al.

(10) Patent No.: US 6,185,843 B1
(45) Date of Patent: Feb. 13, 2001

(54) TOBACCO DRYERS

(75) Inventors: William John Stone, Southampton; Ian Ernest Tatham, Purley, both of (GB); Werner Hirsch, Hamburg; Arno Eugen Weiss, Norderstedt, both of (DE)

(73) Assignee: British American Tobacco (Investments) Limited, London (GB)

( * ) Notice: Under 35 U.S.C. 154(b), the term of this patent shall be extended for 0 days.

(21) Appl. No.: 09/380,112

(22) PCT Filed: Jul. 31, 1997

(86) PCT No.: PCT/GB97/02050

§ 371 Date: Nov. 30, 1999

§ 102(e) Date: Nov. 30, 1999

(87) PCT Pub. No.: WO98/43501

PCT Pub. Date: Oct. 8, 1998

(30) Foreign Application Priority Data

Mar. 27, 1997 (GB) ..... 9706412

(51) Int. Cl.[7] ..... F26B 17/00

(52) U.S. Cl. ..... 34/583; 34/588; 34/68; 131/290; 131/296

(58) Field of Search ..... 34/583, 588, 68, 34/181, 182, 183; 131/290, 296, 300, 302, 304, 306

(56) References Cited

U.S. PATENT DOCUMENTS

| | | | | |
|---|---|---|---|---|
| 4,251,356 | * | 2/1981 | Harte | 209/250 |
| 4,523,598 | * | 6/1985 | Weiss et al. | 131/291 |
| 5,307,822 | * | 5/1994 | Egri | 131/296 |
| 5,908,032 | * | 6/1999 | Poindexter et al. | 131/291 |

* cited by examiner

*Primary Examiner*—Pamela Wilson
(74) *Attorney, Agent, or Firm*—Pitney, Hardin, Kipp & Szuch, LLP

(57) ABSTRACT

A pneumatic conveyance tobacco dryer which includes a conveyance duct having a first portion, a second, upwardly extending portion and a third, curved portion intercommunicating the first and second portions. A tobacco feed chute extends downwardly and opens into the second portion of the duct. The geometry of the dryer at and in the region of the feed chute is such as to effect the object of reducing the contact of tobacco particles with the inner surfaces of the conveyance duct.

14 Claims, 2 Drawing Sheets

TOBACCO DRYERS

Figure 1:
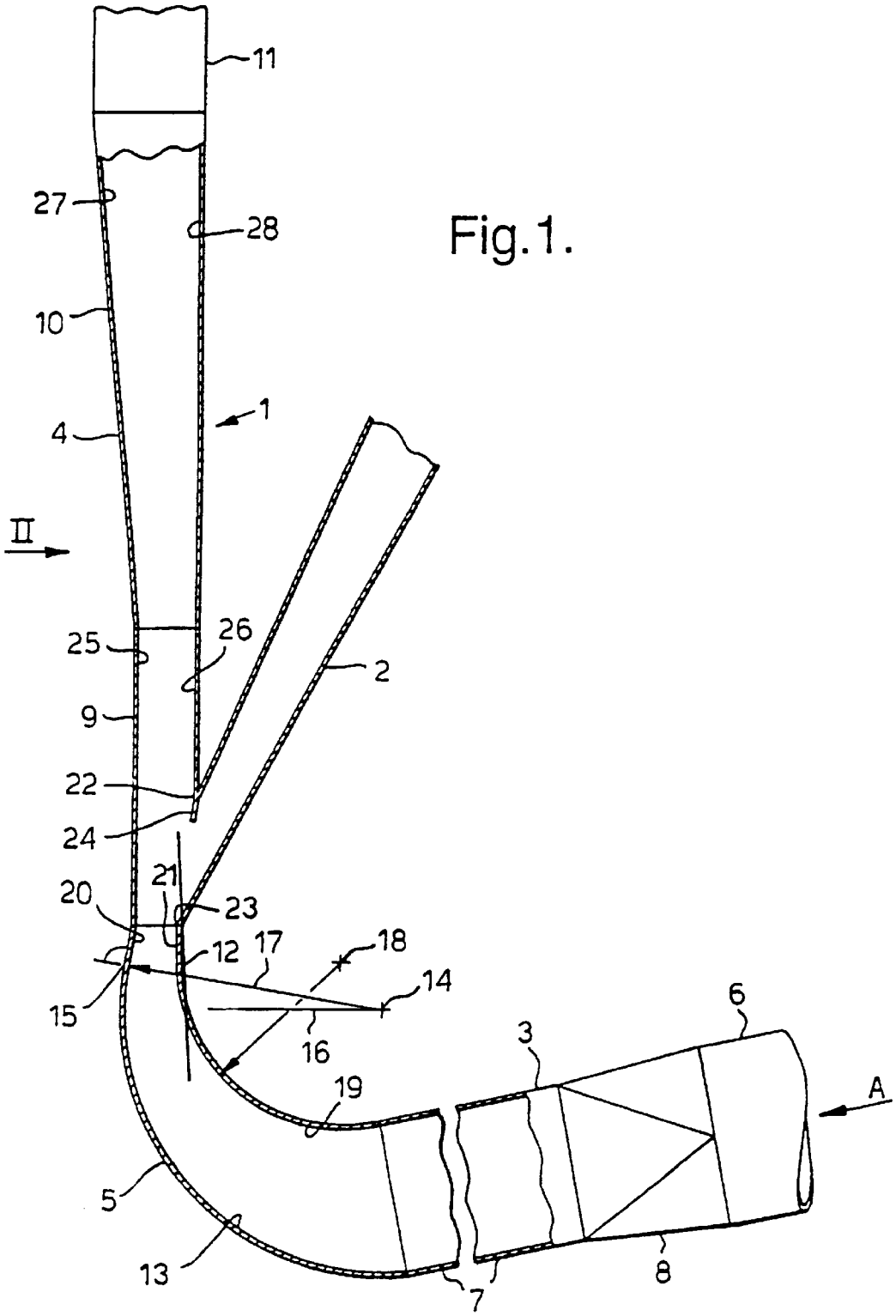

The subject invention relates to pneumatic conveyance tobacco dryers.

In the process of drying particulate tobacco in a pneumatic conveyance tobacco dryer a flow of hot gaseous medium-air, steam or an air/stem mixture for example—is established through an elongate pneumatic conveyance duct, and the tobacco is fed into the duct, whereby the tobacco particles become entrained in the flow of the hot gaseous medium. The tobacco is subsequently separated from the gaseous medium by means of a separator, such, for example, as a cyclone or a tangential separator. The contact time of the tobacco particles with the gaseous medium is short, being typically in a range of from less than one second up to about 6 seconds.

Heretofore, difficulties have been experienced in the feeding of tobacco to a pneumatic conveyance dryer in such manner as to avoid the creation of static accumulations of tobacco particles at localities within the conveyance duct, with the accompanying risk of the occurrence of fires in the duct.

The subject invention has as an object the provision of means for obtaining an improved mode of feeding particulate tobacco into the conveyance duct of a pneumatic conveyance dryer.

The subject invention provides a pneumatic conveyance tobacco dryer comprising a pneumatic conveyance duct and a downwardly extending tobacco feed chute, said duct comprising a first portion, a second, upwardly extending portion and a third, curved portion extending from the first portion to the lower end of the second portion and whereby the first portion is in gas flow communication with the second portion, the lower end of the feed chute opening into the second portion of the duct and being located to the same side of said second portion of the duct as is the first portion of the duct, characterised in that in vertical, axial section of the third portion of the duct, the interior curved surface at the outside of the curve of the third portion conforms to a line at constant distance (radius) from a point which is located below the junction of the second and third portions of the duct, and which line continues, at the constant distance from said point, above the level of said point.

By preference, the said constant radius line terminates at such level above the level of said point that a radial line, extending from the point to the constant radius line at said level above that of the point, extends at or about 10 degrees to the horizontal.

It is preferable that, as viewed in vertical axial section of the third portion of the pneumatic conveyance duct, the interior curved surface at the inside of the curve of the third portion conforms to a second line at constant distance (radius) from a second point, which second point is located above the level of the first mentioned point, and said second line does not continue, or does not substantially continue, at the said constant distance from said second point, above the level of said second point. suitably, the second point is at the same level, or at about the same level, as is the upper termination of the first mentioned line of constant radius.

Advantageously, as viewing a vertical, axial section of the second portion of the pneumatic conveying duct, the location of the upper junction of the interior of the tobacco feed chute with the interior of the second portion of the duct is offset from a vertical line extending from the lower junction of the interior of the chute with the interior of the duct, the upper junction being located to the same side of said vertical line as is located the first portion of the duct.

Again as viewing a vertical section of the second portion of the duct, a straight line extending from the said lower junction to the said upper junction suitably extends at an angle to the vertical of or about 7 degrees. Plate means may extend downwardly from the said upper junction in alignment with the just mentioned notional line interconnecting the said upper and lower junctions. The plate means may extend, for example, for about one sixth of the distance between the upper and lower junctions.

The second portion of the pneumatic conveyance duct preferably extends vertically. The second portion of the duct suitably comprises two abutting sections, the first of which sections extends upwardly from the lower end of the tobacco feed chute and is of constant internal transverse cross-section, and the second of which sections extends upwardly from the upper end of the first section and is upwardly divergent internally. In such case it is advantageous that, as viewing a vertical section of the second portion of the duct, the interior of the second section thereof is upwardly divergent at that side of the duct opposite that at which the interior of the tobacco feed chute opens into the duct. Suitably, the divergence is linearly proportional. The divergence may, for example, be in the proportion of 1 in 10, in which case the divergent interior wall of the said second section would extend at 5.7 degrees to the vertical.

Suitably, the included angle between the respective axes of the said second portion and the tobacco feed chute is at or about 30 degrees.

Suitably, the internal transverse cross-section of the third portion of the pneumatic conveyance duct is of rectangular conformation and the arrangement is such that the wider of the central transverse and longitudinally extending planes of the interior of the said third portion, i.e. planes parallel to the wider internal walls of the third portion, are curved in accordance with the curving of the third portion. Suitably, the internal transverse cross-section of the second portion of the duct too is of rectangular conformation, in which case the respective internal transverse cross-sections of the second and third portions of the duct at the juncture therebetween are the same and in the same orientation.

Suitably, an airlock for the feed of tobacco is provided at the upper end of the tobacco feed chute.

In order that the subject invention may be readily understood and carried into effect, reference will now be made, by way of example, to the diagrammatic drawings herewith, FIG. 1 of which depicts parts of a pneumatic conveyance tobacco dryer, which parts are at and adjacent to the tobacco infeed location of the dryer, and FIG. 2 of which drawings shows a view of the dryer looking in the direction of Arrow II of FIG. 1.

The pneumatic conveyance dryer, parts of which are depicted in the drawings, comprises a pneumatic conveyance duct, which duct is generally designated by reference numeral 1, and a downwardly extending tobacco feed chute 2. The duct 1 comprises a first lengthwise portion 3, a second, vertically extending lengthwise portion 4 and a third, curved lengthwise portion 5 extending from the first portion 3 to the lower end of the second portion 4, whereby the first portion 3 is in gas flow communication with the second portion 4. The orientation of portion 3 of the duct 1 is transverse to that of the second portion 4 and, as can be observed from FIG. 1, portion 3 extends at an angle (of about 10 degrees) to the horizontal downwardly towards the third portion 5.

In operation of the dryer, gas flow in the duct 1 is in the direction indicated by the arrow A in FIG. 1.

The first portion 3 of the duct 1 comprises an upstream section 6 of circular internal transverse cross-section, and a downstream section 7 of rectangular internal transverse cross-section. The first portion 3 further comprises a transition section 8 serving to interconnect the sections 6 and 7.

The second portion 4 of the duct 1 comprises a first section 9. The tobacco feed chute 2 opens into the portion 4 of the duct 1 at a lower zone of the section 9 of the portion 4. As may be observed from FIG. 1, the chute 2 is located to that side of portion 4 at which extend the portions 3 and 5.

The second portion 4 of the duct 1 further comprises a second section 10, which section 10 extends upwardly from the upper end of section 9, a third section 11, which section 11 extends upwardly from the upper end of section 10, and a fourth, short section 12, which section 12 connects with the upper end of curved portion 5 of the duct 1.

Figure 2:
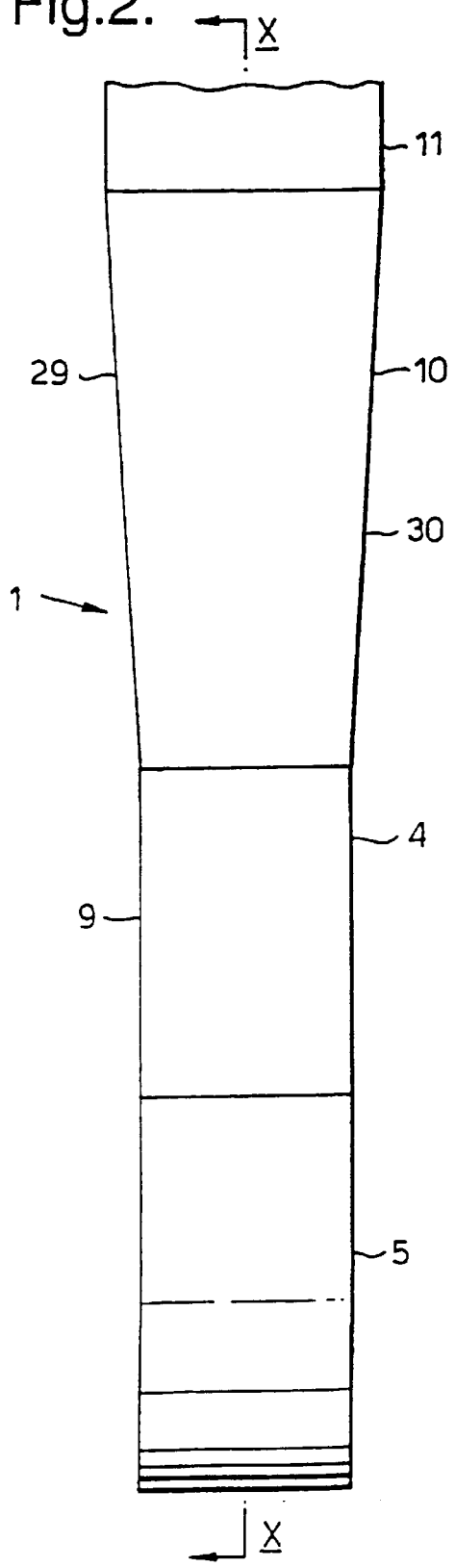

In FIG. 1 sections 6 and 8 of portion 3 of the duct 1 and section 11 of portion 4 thereof are shown externally, whereas section 7 of portion 3, portion 5, sections 9, 10 and 12 of portion 4 and feed chute 2 are all shown in vertical cross-section, i.e. on plane X—X of FIG. 2.

As mentioned hereinabove, section 7 of the portion 3 of the duct 1 is of rectangular internal transverse cross-section. Similarly, the second and third portions 4 and 5 of the duct 1 are of rectangular internal transverse cross-section, with the length of the major internal cross-sectional dimensions of portion 5 and the section 9 of portion 4, i.e. widthwise dimensions in FIG. 2, being closely similar to that of section 7 of portion 3.

The internal transverse cross-section of the tobacco feed chute 2 is also of rectangular conformation, and again the major dimension is perpendicular to the plane of FIG. 1. The length of the major dimension of the internal cross-section of the chute 2 is the same as that of section 9 of the portion 4 of duct 1.

Interior surface 13 at the outside of the curve of the portion 5 of the duct 1 is at a constant radial distance from a notional line extending perpendicularly of the plane of FIG. 1, which line is at a location designated by reference numeral 14 in FIG. 1. As may be observed from FIG. 1, the curved surface 13 extends, at the said radial distance, up to a terminal location, designated by reference numeral 15, which location 15 is above the level of location 14. In FIG. 1 reference numeral 16 designates a horizontal straight line extending through location 14, and 17 designates a straight (radial) line extending through both location 14 and location 15. The included angle of lines 16 and 17 is 10 degrees.

Reference numeral 18 in FIG. 1 designates the location of a notional line which extends perpendicularly of the plane of FIG. 1. Interior surface 19 at the inside of the curve of the portion 5 of the duct 1 is at a constant radial distance from the said line at location 18, and curved surface 19 extends up to, but not beyond, the level of location 18. Location 18 is at the same level as location 15.

The opposed inner surfaces 20, 21 of section 12 of the portion 4 of the duct 1, as viewing FIG. 1, extend without curvature. Surface 20 extends perpendicularly of line 17 and surface 21 extends vertically.

The upper line of junction, at location 22 (FIG. 1), of the interior of the tobacco feed chute 2 with the interior of section 9 of the portion 4 of the duct 1 is offset from a vertical plane extending through the lower line of junction, at location 23, of the interiors of the chute 2 and the section 9. As may be observed from FIG. 1, the upper line of junction at 22 is offset, relative to the lower line of junction at 23, to that side at which extend portions 3 and 5 of the duct 1. As viewing FIG. 1, the included angle between a straight line which extends through both of locations 22 and 23, and a vertical line (not shown) which extends through location 23, is 7 degrees.

A plate 24 extends downwardly from the upper junction at 22, the plane of the plate 24 being in alignment with the aforementioned notional line extending through locations 22 and 23. The plate 24 extends for the full length of the aforesaid major dimensions of the internal cross-sections of the tobacco feed chute 2 and the section 9 of portion 4 of the duct 1.

Whereas opposed inner surfaces 25 and 26 of the section 9 of portion 4 of the duct 1 each extends vertically, one only of the opposed inner surfaces 27 and 28 of section 10, namely surface 28, extends vertically or substantially vertical. As may be seen from FIG. 1, surface 28 extends in alignment with surface 26 of section 9. The other of the said opposed inner surfaces of section 10, i.e. surface 27, diverges upwardly, the angle of divergence to the vertical being 5.7 degrees. As may be observed from FIG. 1, the divergent surface 27 is to the opposite side of duct 1 from the side thereof at which is disposed the opening of the tobacco feed chute 2 into the duct 1.

With reference to FIG. 2, opposed walls 29 and 30 of section 10 of portion 4 of the duct 1 are equally upwardly divergent, the angle of divergence to the vertical for each of walls 29, 30 and of the inner surfaces thereof being about 4 degrees.

To the upper end of the tobacco feed chute 2 is located a tobacco feed airlock (not shown) operable for the feed of particulate tobacco into the chute 2. As will be readily appreciated by those skilled in the art, the pneumatic conveyance tobacco dryer which comprises those parts depicted in the drawings, comprises too other elements which are not shown in the drawing, namely:

- gaseous medium heating means, as for example, a gas fired direct heater;
- gaseous medium circulating means, as for example, a gas circulation fan; and
- tobacco/gas separating means, as for example, a cyclone tobacco/gas separator.

The gaseous medium heating means is located upstream of the portion 3 of the duct 1 and is in gas flow communication with portion 3. The gaseous medium circulating means is located upstream of the gaseous medium heating means and is in gas flow communication therewith. The tobacco/gas separating means is located downstream, i.e. above, the portion 4 of the duct 1 and is in gas flow communication with portion 4. Duct means (also not shown) serves to provide gas flow communication between the gas outlet of the tobacco/gas separating means and the gas inlet of the gaseous medium circulating means.

In operation of the dryer, the heating and circulating means are placed in respective continuous operation modes, whereby a hot gaseous medium flows continuously through duct 1, and particulate tobacco, cut lamina tobacco for example, is fed continuously and at a constant flow rate, down feed chute 2, whereby the tobacco is entrained in the hot gaseous medium. After a short residence time in duct 1, the now dried and expanded tobacco is separated from the gaseous medium in the separating means.

Because the dryer embodies geometrical features of the duct 1/chute 2 combination as above described, the dryer operates with much reduced contact of the tobacco particles with duct inner surfaces than has been the case with prior pneumatic conveyance tobacco dryers. Consequently, the creation of static accumulations of tobacco particles is wholly, or substantially wholly, obviated.

Pneumatic conveyance dryers according to the subject invention, as well as being effective for drying and expanding particulate tobacco, may be effective for the drying or drying and expanding of other vegetable materials.

What is claimed is:

1. A pneumatic conveyance tobacco dryer comprising a pneumatic conveyance duct and a downwardly extending tobacco feed chute, said duct comprising a first portion, a second, upwardly extending portion having a lower end and a third, curved portion extending from the first portion to a junction with the lower end of the second portion and whereby the first portion is in gas flow communication with the second portion, said first portion of the duct being located to one side of said second portion of the duct and a lower end of the feed chute opening into the second portion of the duct at a junction of the second portion of the duct with the feed chute at that side of the second portion of the duct to which side the first portion of the duct is located, wherein in a vertical, axial section of the third portion of the duct, the third portion comprises a curve wherein an interior curved surface at an outside of the curve conforms to a line at constant distance from a first point which is located at a level below the junction of the second and third portions of the duct, and which line continues, at the constant distance from said first point, above the level of said first point.

2. A dryer according to claim 1, wherein said line terminates at such level above the level of said first point that a radial line, extending from said first point to said line at said level above the level of said first point, extends at or about 10 degrees to the horizontal.

3. A dryer according to claim 1, wherein in vertical, axial section of said third portion of said duct, an interior curved surface at an inside of the curve of said third portion conforms to a second line at constant distance from a second point, which second point is located above the level of the first point, and said second line does not substantially continue, at said constant distance from said second point, above the level of said second point.

4. A dryer according to claim 3, wherein said second point is at substantially the same level as the level of upper termination of the first mentioned line of constant radius.

5. A dryer according to claim 1, wherein in vertical, axial section of said portion of said duct, said feed chute and said second portion of the duct each comprise an interior and wherein an upper junction of the interior of said feed chute with the interior of said second portion is offset from a vertical line extending from a lower junction of the interior of said chute with the interior of said duct, said first portion of the duct being located to one side of said vertical line and said upper junction being located to a side of said vertical line, which side is the same as that side to which said first portion of said duct is located.

6. A dryer according to claim 5, wherein a straight line extending from said upper junction to said lower junction extends at about 7 degrees to the vertical.

7. A dryer according to claim 5, wherein plate means extends downwardly from said upper junction towards said lower junction.

8. A dryer according to claim 1, wherein said second portion of said duct comprises a section having an interior which interior extends upwardly of a junction of said feed chute with said duct, the interior of said section being upwardly divergent.

9. A dryer according to claim 8, wherein in vertical, axial section of said section, the interior of said section is upwardly divergent at a side of said duct, which side is opposite that of said junction of said feed chute with said duct.

10. A dryer according to claim 9, wherein at a side of the interior of said section opposite said side thereof which is upwardly divergent, a surface bounding said interior of said section extends substantially vertically.

11. A dryer according to claim 8, wherein the interior of said second portion is bounded by surfaces and wherein an internal transverse cross-section of said section of said second portion of said duct is of rectangular conformation, a wider surface of the surfaces bounding the interior of said section of said second portion being to a side of said second portion at which said feed chute is located.

12. A dryer according to claim 1, wherein an internal transverse cross-section of said third portion of said duct is of rectangular conformation, opposed wider surfaces bounding an interior of said third portion being surfaces which are longitudinally curved.

13. A dryer according to claim 1, wherein an interior of said second portion is bounded by surfaces and wherein an internal transverse cross-section of said second portion of said duct is, at least in a zone of the junction of said feed chute with said duct, of rectangular conformation and said chute opens into said second portion at a wider surface of the surface s bounding the interior of said second portion.

14. A dryer according to claim 1, wherein an internal transverse cross-section of said feed chute is of rectangular conformation and a longer dimension of said internal transverse cross-section is disposed horizontally.

* * * * *